US011965657B2

(12) United States Patent
Cadima

(10) Patent No.: US 11,965,657 B2
(45) Date of Patent: Apr. 23, 2024

(54) COOKTOP APPLIANCE WITH TEMPERATURE SENSOR

(71) Applicant: Haier US Appliance Solutions, Inc., Wilmington, DE (US)

(72) Inventor: Paul Bryan Cadima, Crestwood, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 38 days.

(21) Appl. No.: 17/840,956

(22) Filed: Jun. 15, 2022

(65) Prior Publication Data

US 2023/0408100 A1 Dec. 21, 2023

(51) Int. Cl.
*F24C 3/12* (2006.01)
*F24C 15/10* (2006.01)

(52) U.S. Cl.
CPC ..... *F24C 3/126* (2013.01); *F24C 15/107* (2013.01)

(58) Field of Classification Search
CPC ..... F24C 3/085; F24C 15/107; F23N 2225/16
USPC ..... 126/39 R, 42, 39 E, 39 H, 39 N, 39 J, 126/39 K
See application file for complete search history.

(56) References Cited

U.S. PATENT DOCUMENTS 9,175,858 B2 * 11/2015 Tisselli ..... F24C 3/122
2020/0182476 A1 * 6/2020 Bentley ..... F24C 3/126

FOREIGN PATENT DOCUMENTS

| | | | |
|---|---|---|---|
| CN | 204853578 | U | 12/2015 |
| CN | 110645596 | A | 1/2020 |
| CN | 111425895 | A | 7/2020 |
| GB | 969096 | A | 9/1964 |
| JP | 2019002666 | A | 1/2019 |

* cited by examiner

*Primary Examiner* — Vivek K Shirsat
(74) *Attorney, Agent, or Firm* — Dority & Manning, P.A.

(57) ABSTRACT

A cooktop appliance includes a top panel with a gas burner disposed on the top panel. The cooktop appliance also includes a grate with a plurality of fingers. The grate is removably positioned above the gas burner. The plurality of fingers includes a sensor finger. The cooktop appliance also includes a temperature sensor extending from the top panel adjacent to the gas burner. The temperature sensor is positioned outside of a footprint of the gas burner. The cooktop appliance further includes a thermally conductive probe extending from the temperature sensor to the sensor finger above the gas burner.

20 Claims, 8 Drawing Sheets

COOKTOP APPLIANCE WITH TEMPERATURE SENSOR

FIELD OF THE INVENTION

The present subject matter relates generally to cooktop appliances with one or more gas burners, and in particular to such cooktop appliances with one or more temperature sensors therein.

BACKGROUND OF THE INVENTION

Gas cooktop appliances generally include a plurality of gas burners mounted at a top surface of the appliance. Gas burners heat a cooking utensil positioned on a grate over the gas burner primarily via convective heating. Thus, measuring cooking utensil temperatures on gas cooktop appliances poses challenges because any sensor that contacts the cooking utensil is significantly heated by swirling heated air from the gas burner.

Some gas cooktops include a sensor that passes through the gas burner and presses against the cooking utensil on the grate. Such sensors have drawbacks. For example, assembly and cleaning of burner parts is greatly complicated due to the construction of the gas burner that includes a sensor passing through the gas burner. As another example, openings in the gas burner and other cooktop components that accommodate the sensors can undesirably pass spills through the gas burner. Such temperature sensors also generally include sensitive electronics which may not be robust for a cooking environment, e.g., due to spills or dripping from the cooking surface which may contaminate the sensor. Additionally, such temperature sensors may not be robust for cleaning, e.g., the temperature sensor may not be suitable for submersion during washing or washing in a dishwasher appliance.

Accordingly, a gas cooktop appliance with features for monitoring the heating provided, such as monitoring for excessive cookware temperatures, e.g., temperatures in excess of a temperature limit, would be useful. In particular, a gas cooktop appliance with robust, durable features for monitoring a temperature of a cooking utensil thereon would be useful.

BRIEF DESCRIPTION OF THE INVENTION

Aspects and advantages of the invention will be set forth in part in the following description, or may be apparent from the description, or may be learned through practice of the invention.

In an example embodiment, a cooktop appliance is provided. The cooktop appliance defines a vertical direction, a lateral direction, and a transverse direction. The vertical direction, the lateral direction, and the transverse direction are mutually perpendicular. The cooktop appliance includes a top panel with a gas burner disposed on the top panel. The cooktop appliance also includes a grate with a plurality of fingers. The grate is removably positioned above the gas burner. The plurality of fingers includes a sensor finger. The cooktop appliance also includes a temperature sensor extending upward along the vertical direction from the top panel adjacent to the gas burner. The temperature sensor is positioned outside of a footprint of the gas burner. The cooktop appliance further includes a thermally conductive probe extending from the temperature sensor to the sensor finger above the gas burner.

In another example embodiment, a cooktop appliance includes a top panel with a gas burner disposed on the top panel. The cooktop appliance also includes a grate with a plurality of fingers. The grate is removably positioned above the gas burner. The plurality of fingers includes a sensor finger. The cooktop appliance also includes a temperature sensor extending from the top panel adjacent to the gas burner. The temperature sensor is positioned outside of a footprint of the gas burner. The cooktop appliance further includes a thermally conductive probe extending from the temperature sensor to the sensor finger above the gas burner.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
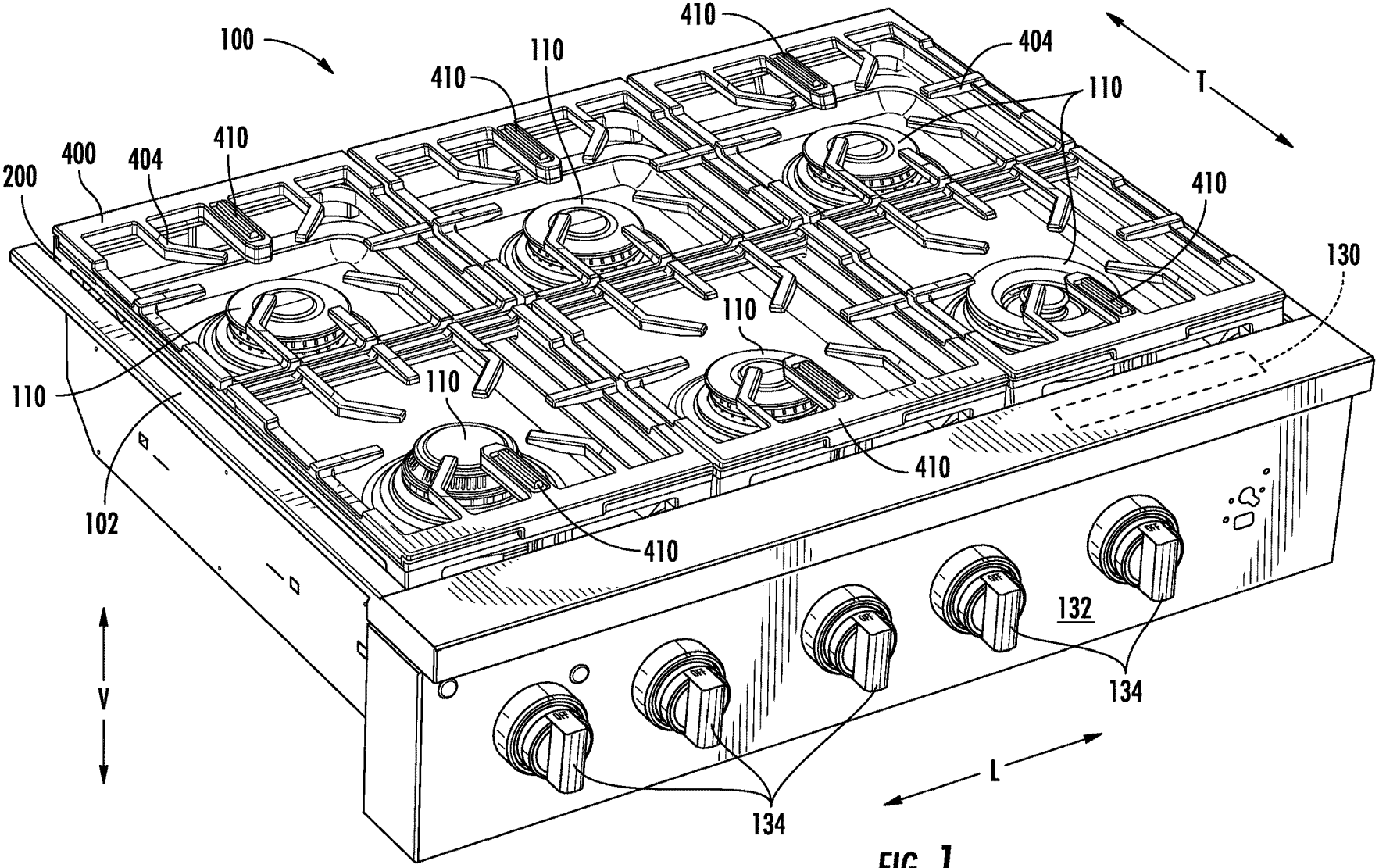
FIG. 1 provides a perspective view of a cooktop appliance according to one or more example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

FIGS. 1 through 5 illustrate an exemplary cooktop appliance 100 according to one or more example embodiments of the present disclosure. The example cooktop appliance 100 includes a top panel 102. The cooktop appliance 100 extends in a lateral direction L and a transverse direction T, e.g., perpendicular to a vertical direction V. Each of the vertical direction V, lateral direction L, and transverse direction T is mutually perpendicular to every other of the vertical direction V, the lateral direction L, and the transverse direction T, such that an orthogonal direction system is formed.

Figure 2:
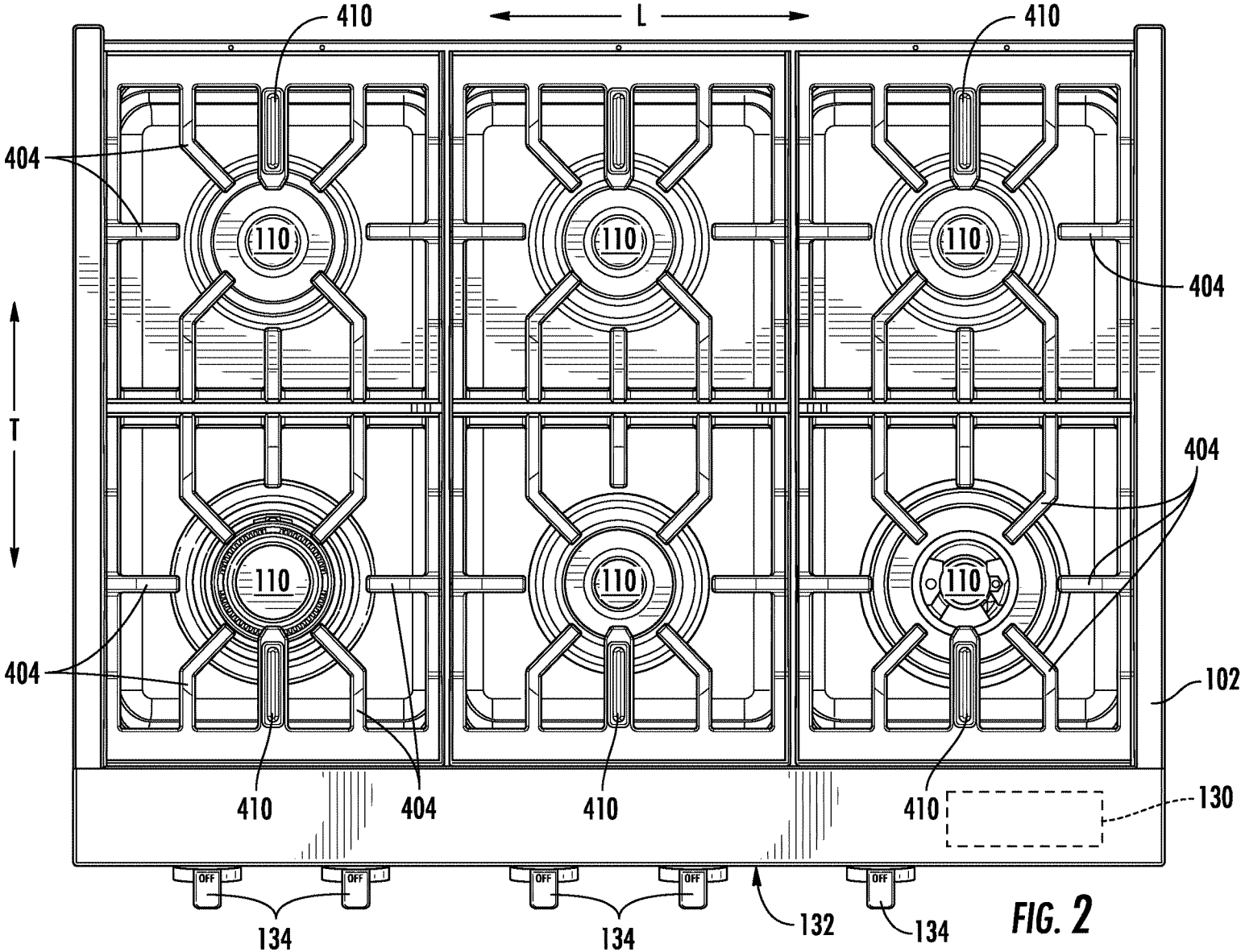
FIG. 2 provides a plan view of the example cooktop appliance of FIG. 1.

More particularly, FIGS. 1 and 2 depict the exemplary cooktop appliance 100 with a plurality of frames 200 mounted on the panel 102, with each frame 200 positioned above and around a pair of gas burners 110, and a pair of grates 400 mounted on each frame 200. Thus, each grate 400 in the illustrated exemplary embodiments corresponds to one burner 110. The panel 102 may include a top surface 104 and a bottom surface 106. By way of example, the panel 102 may be constructed of enameled steel, stainless steel, glass, ceramics, and combinations thereof.

As may be seen, e.g., in FIGS. 1 through 5, the cooktop appliance 100 may include a plurality of burners. For example, the cooktop appliance 100 may include a plurality of burners 110 disposed on the top panel 102. For example, as illustrated, the burners 110 may be arranged along a regular array wherein the burners 110 are uniformly spaced apart along the lateral direction L and the transverse direction T. In additional embodiments, the cooktop appliance 100 may include any suitable number and arrangement of burners, including burners of varying sizes and shapes. The panel 102 may also include a recessed portion 108, e.g., which extends downward along the vertical direction V. The burners 110 may be positioned within the recessed portion 108. The recessed portion 108 may collect spilled material, e.g., foodstuffs, during operation of the cooktop appliance.

The cooktop appliance 100 may also include a user interface panel 132 located within convenient reach of a user of the cooktop appliance 100. In various embodiments, the user interface panel 132 may include user inputs 134, such as knobs, buttons, or a touchscreen, etc., which are generally understood by those of ordinary skill in the art and are therefore not shown or described in extensive detail herein for the sake of brevity and clarity. The user inputs 134 may allow the user to activate one or more burners 110 and determine an amount of heat provided by each gas burner 110. The user interface panel 132 may also be provided with one or more graphical display devices that deliver certain information to the user, e.g., whether a particular burner is activated and/or the output level at which the burner is set.

Operation of the cooktop appliance 100 can be regulated by a controller 130 that is operably coupled to (i.e., in operative communication with) the user inputs and/or gas burners. For example, in response to user manipulation of the user input(s), the controller 130 operates one or more of the burners 110. By way of example, the controller 130 may include a memory and one or more processing devices such as microprocessors, CPUs or the like, such as general or special purpose microprocessors operable to execute programming instructions or micro-control code associated with operation of appliance 100. The memory may represent random access memory such as DRAM, or read only memory such as ROM or FLASH. In some embodiments, the processor may execute programming instructions stored in non-transitory memory. For example, the instructions may include a software package configured to operate appliance 100 and execute an operation routine such as one or more methods of operating the cooktop appliance 100. The memory may be a separate component from the processor or may be included onboard within the processor. The controller 130 may be programmed to operate the cooktop appliance 100 by executing instructions stored in memory. For example, the instructions may be software or any set of instructions that when executed by the processing device, cause the processing device to perform operations. Controller 130 may be configured to perform a variety of computer-implemented functions and/or instructions (e.g. performing methods, steps, calculations and the like and storing relevant data). It should be noted that controllers 130 as disclosed herein are capable of and may be operable to perform any methods and associated method steps as may be disclosed herein.

The controller 130 may be disposed in a variety of locations throughout appliance 100. Input/output ("I/O") signals may be routed between the controller 130 and various operational components of appliance 100, such as the gas burners 110, inputs 134, a graphical display, one or more sensors, and/or one or more alarms. For example, the controller 130 may be in operative communication with one or more temperature sensors 450, e.g., as will be described in more detail below, the controller 130 may be in operative communication with one or more temperature sensors 450 positioned on, e.g., mounted to, the top panel 102.

Generally, each gas burner 110 includes a generally circular shape from which a flame may be emitted. In additional embodiments, one or more of the burners may have a different shape, such as oval, oblong, obround, etc., among other possible shapes. As may be seen, e.g., in FIG. 3, each gas burner 110 (or the gas burner 110 in embodiments where only one gas burner 110 is provided) includes a plurality of fuel ports 114 defined perimetrically, e.g., circumferentially, therearound. The plurality of fuel ports 144 may be arranged in groups, e.g., the fuel ports 114 may be arranged with one or more gaps 112 between adjacent fuel ports 114 around the circumference of the gas burner 110 rather than continuously around the circumference of the gas burner 110. Each fuel port 114 is in fluid communication with an internal passage of each respective burner 110. In some embodiments, e.g., as illustrated in FIG. 1, one or more of the burners 110 may be a multi-ring burner including a first plurality of fuel ports defining a first ring of the burner 110 and a second plurality of fuel ports defining a second ring of the burner 110 (such as the three burners 110 along the back row in FIG. 1, where "back" is used with reference to the perspective of a user at the user interface panel 132, e.g., the back row is the row of burners 110 farthest from the user interface panel 132 along the transverse direction T), and the first and second rings may be spaced apart along the vertical direction V and/or may be concentric rings. In some embodiments of a cooktop appliance, multiple burners of differing types may be provided in combination, e.g., one or more single-ring burners as well as one or more multi-ring burners. Moreover, other suitable burner configurations are also possible.

As mentioned above, the cooktop appliance 100 may also include a frame 200 which may be mounted, such as removably mounted, to the top surface 104 of the panel 102. The frame 200 may be configured to selectively support one or more grates 400 over the burners 110. The frame 200 may thusly be positioned above the plurality of gas burners 110, e.g., along the vertical direction V. For instance, in some embodiments, the frame 200 may span the two burners 110, e.g., the frame 200 may consist of a single piece spanning unsupported across a first burner of the plurality of burners 110 and a second burner 110 of the plurality of burners.

For example, the frame 200 may include or consist of four corners, and may have a leg 226 extending generally along the vertical direction V at each corner. As will be described further below, the frame may include a shroud or sleeve 222. In embodiments where the frame 200 includes the sleeve 222, the sleeve 222 may be positioned between the corners, e.g., between the legs 226. The legs 226 of the frame 200 may be positioned on top panel 102, e.g., may extend from an outer rail 202 of the frame 200 to the top surface 104 of panel 102 when the frame 200 is mounted on the panel 102. The outer rail 202 may extend around and at least partially define an external perimeter of the frame 200.

In some embodiments, the frame 200 may span unsupported across a first burner 110 and a second burner 110, e.g., without any legs or other portions of the frame 200 resting on the panel 102 between the legs 226 and/or between the burners 110, along the transverse direction T. The first and second burners 110 may be positioned between the legs 226 along the transverse direction T when the frame 200 is mounted to the top surface 104 of the panel 102.

As mentioned, the frame 200 may include an outer rail 202. The outer rail 202 of the frame may extend around a perimeter of the frame, such as completely around the entire perimeter of the frame 200 and may define a peripheral support surface 204 (FIG. 8), e.g., for at least partially supporting the grates 400 thereon. For example, the peripheral support surface 204 may be configured to selectively support a first grate 400 on a first portion, e.g., half, of the peripheral support 204 surface and a second grate 400 on a second portion, e.g., a second half, of the peripheral support surface 204 adjacent to the first portion.

Figure 8:
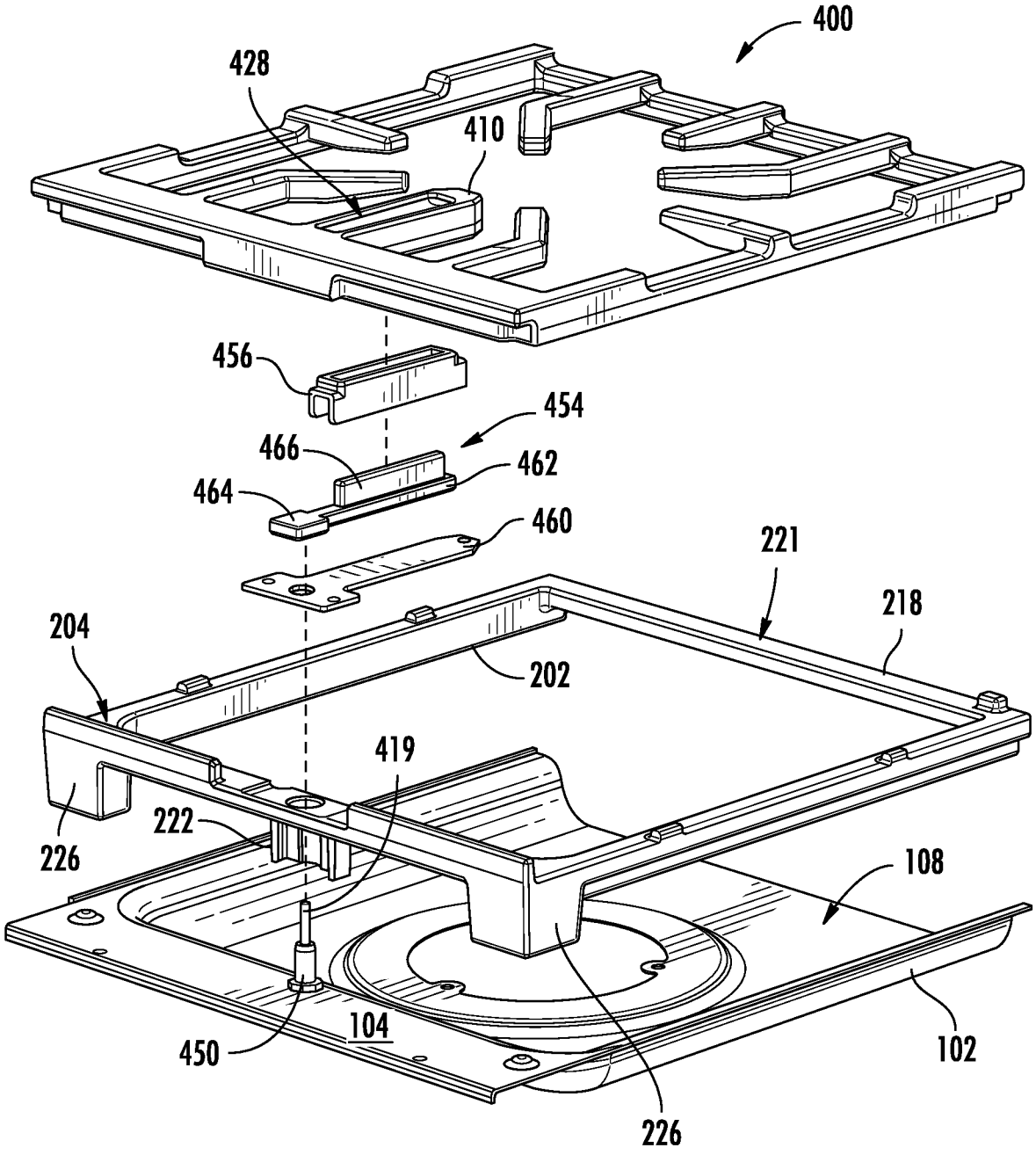
FIG. 8 provides an exploded view of a portion of an exemplary gas burner assembly which may be incorporated into a cooktop appliance such as the example cooktop appliance of FIG. 1.

The frame 200 may also include a crossbar 218 (see, e.g., FIGS. 4 and 5, and note that FIG. 8 is truncated at a vertical plane extending through a center of the crossbar 218) extending through the frame 200 at about the middle of the frame 200. In some embodiments, the crossbar 218 may define an intermediate support surface 221. The intermediate support surface 221 may be configured to selectively support a first grate 400 at a first side of the intermediate support surface 221 and a second grate 400 at a second side of the intermediate support surface 221.

The frame 200 may be formed of cast metal, such as cast iron or steel, such that the outer rail 202, crossbar 218, legs 226, and sleeve 222 are formed from a single, seamless piece of metal. Frame 200 may be removable from panel 102, e.g., by lifting upwardly on the frame 200. Moreover, it is to be understood that further additional or alternative embodiments of the frame 200 may be placed over only one burner assembly or more than two burner assemblies.

In some embodiments, the cooktop appliance includes one or more grates, e.g., the frame 200 or frames 200 may be configured to receive and support a plurality selectively removable grates 400. Each grate 400 may extend at least partially above a corresponding burner 110 when the grates 400 are in a mounted position on the frame 200 and the frame 200 is mounted on the panel 102. Generally, each grate 400 is configured for supporting a cooking utensil, such as a pot, pan, etc., on top of the grate 400 when the grates 400 are in the mounted position on the frame 200 and the frame 200 is mounted on the top panel 102.

For example, each grate 400 of the exemplary embodiment includes a plurality of fingers 404, e.g., formed of cast metal, such as cast iron. The cooking utensil may be placed on the fingers 404 of one of the grates 400 such that the cooking utensil rests on a top surface 468 of some or all of the fingers of the plurality of fingers 404. The grate 400, or each grate 400 in embodiments with a plurality of grates 400, may include an outer frame 406 that extends around or defines a perimeter of first grate 400. Thus, the outer frame 406 may be disposed at an outer portion of the respective grate 400. The fingers 404 of each grate 400 may extend from the respective outer frame 406 such as along a radial direction generally perpendicular to the vertical direction V. For example, the fingers 404 may each extend along the radial direction inward towards a center of the grate 400 and/or a center of the gas burner 110 or a nearest one gas burner 110 of the plurality of gas burners 110 in embodiments which include more than one gas burner 110, from the outer frame 406.

When mounted, the grates 400 may selectively rest on the frame 200, such as on the peripheral support surface 204 and the intermediate support surface 221 thereof.

In some embodiments, the grates 400 may be selectively removable (e.g., to an unmounted position), such that the grates 400 can be readily lifted from the frame 200. In such embodiments, the frame 200 may, in turn, be removable from the top panel 102. In other embodiments, the grates 400 and frame 200 may be formed of a single piece, wherein the one-piece grate 400 and frame 200 may be removable from the top panel 102.

The plurality of fingers 404 includes a sensor finger 410. A temperature probe 454 may be mounted in the sensor finger 410, and the temperature probe 454 may be selectively in conductive thermal communication with a temperature sensor 450 (e.g., when the grate 400 with the temperature probe 454 in the sensor finger 410 thereof is mounted on the top panel 102 and/or on the frame 200), whereby the temperature sensor 450 is operable to indirectly measure a temperature of a cooking utensil on the grate 400. Thus, the grate 400 with the temperature probe 454 therein may be easily removed by a user while the temperature sensor 450 remains in place on the top panel 102. For example, the grate 400 may be removed for cleaning, including washing, such as submerging in a sink or in a dishwasher appliance, where the grate, including the sensor finger 410 thereof, does not include any moisture-sensitive components such as electronic components, e.g., of the temperature sensor 450.

The temperature sensor 450 may be or include any suitable temperature sensor, such as a resistance temperature detector, a thermocouple, an infrared temperature sensor, a bimetallic switch, etc. In particular, the suitable temperature sensor 450 need not necessarily be particularly suited to a high-temperature environment, due to the temperature sensor 450 being spaced apart from and/or shielded from the nearby, e.g., most proximate, gas burner 110 of the plurality of gas burners 110 (in embodiments where a plurality of gas burners are provided, or the gas burner 110 in embodiments where only one gas burner is provided) and combustion products emitted therefrom. For example, the temperature sensor 450 may be positioned outside of a footprint of the gas burner 110. For example, the temperature sensor 450 may be positioned radially outward of a second (radially outermost, with the center of the gas burner 110 or the center of the grate 400 being the center point for reference to the radial direction) end 420 of the sensor finger 410. For example, the temperature sensor 450 may be positioned away from all fingers 404 or 410 of the grate 400, such as the temperature sensor 450 may be positioned below the outer frame 406 of the grate 400, e.g., directly below the outer frame 406 along the vertical direction V.

As may be seen in FIGS. 4, 5, 6, and 7, the sensor finger 410 defines a slot 414 at a bottom surface 416 of the sensor finger 410. The slot 414 is open and faces downward, e.g., along the vertical direction V, such as towards the panel 102 when the grate 400 is in the mounted position on the panel 102.

A cover plate 460 may also be mounted to the sensor finger 410 within the slot 414 or adjoining the slot 414 at the bottom surface 416 of sensor finger 410. Cover plate 460 may be positioned between the temperature probe 454 and gas burner 110, e.g., along the vertical direction V. Thus, cover plate 460 may advantageously shield thermally conductive probe 454 from direct heating by gas burner 110. For example, cover plate 460 may block direct radiative heat transfer from surfaces at gas burner 110 to the temperature sensor 450, and/or cover plate 460 may shield the temperature probe 454 from direct convective heat transfer from gas burner 110 and/or combustion products, e.g., flames and/or heated gases, emanating from the gas burner 110. For example, in some embodiments, the cover plate 460 may be fastened to the sensor finger 410.

In some embodiments, the sensor finger 410 extends between a first end 418 and a second end 420 from the outer frame 406 of the grate 400 along a radial direction that is generally perpendicular to the vertical direction V towards a center of the gas burner 110. In some embodiments, sensor finger 410 may be elongated between the first and second ends 418, 420 of sensor finger 410. Second end 420 of sensor finger 410 may be positioned at the outer frame 406 of the grate 402. Conversely, first end 418 of sensor finger 410 may be spaced from the outer frame 406, and may be positioned above the corresponding gas burner 110 when the grate 400 is mounted on the frame 200, e.g., as best seen in FIG. 3.

Figure 3:
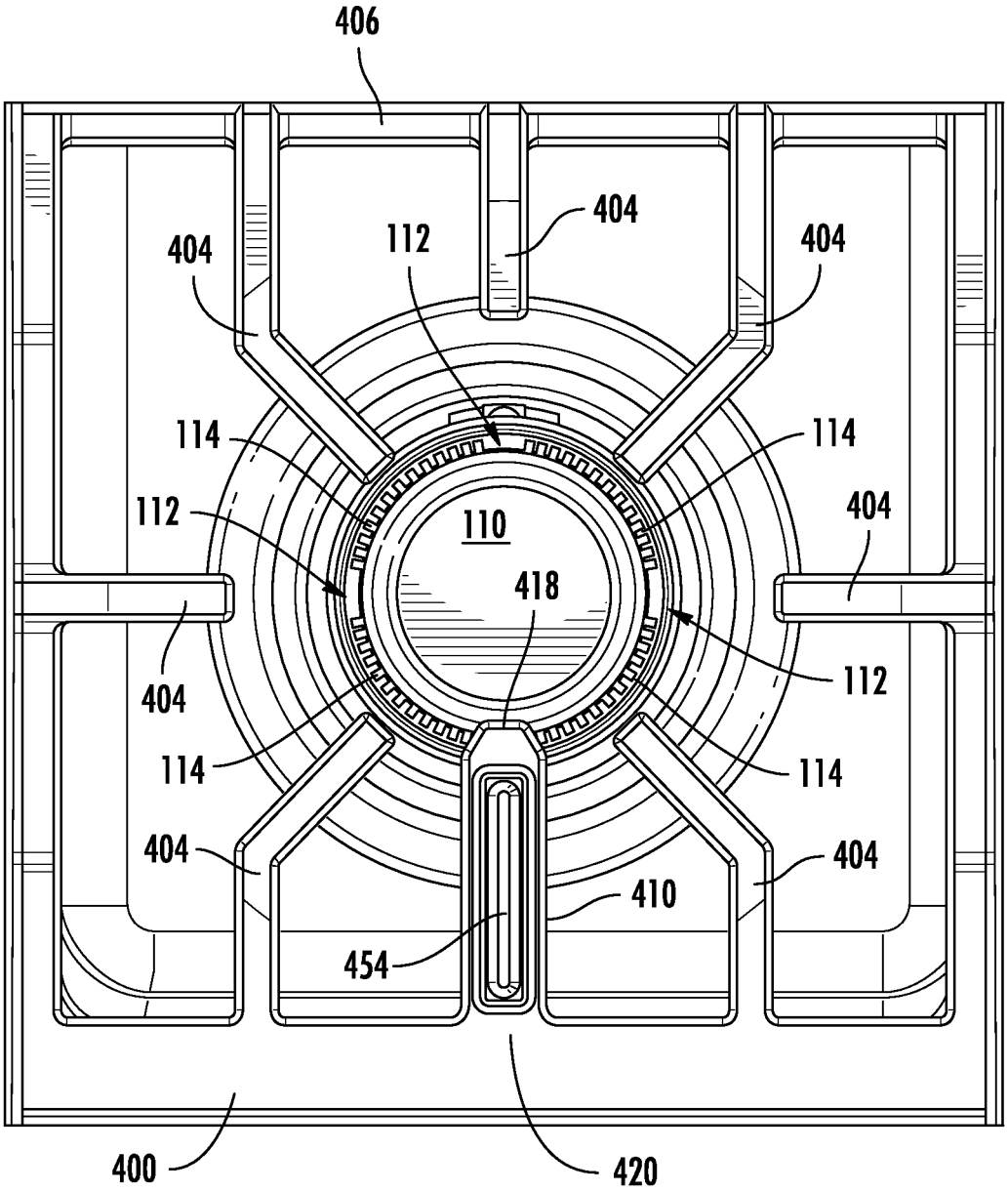
FIG. 3 provides a plan view of an exemplary gas burner assembly which may be incorporated into a cooktop appliance such as the example cooktop appliance of FIG. 1.
Figure 4:
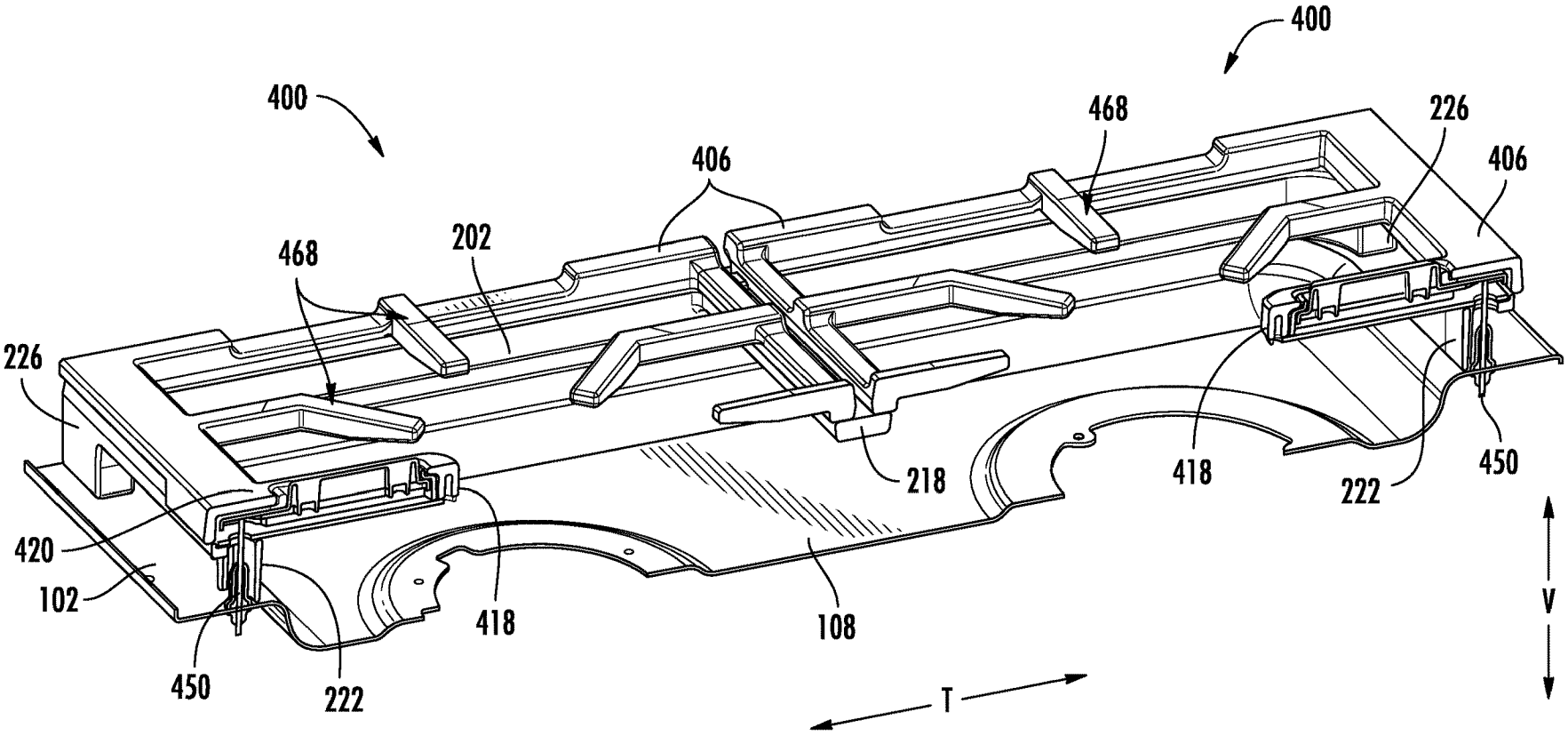
FIG. 4 provides a partially sectioned perspective view of the example cooktop appliance of FIG. 1.
Figure 5:
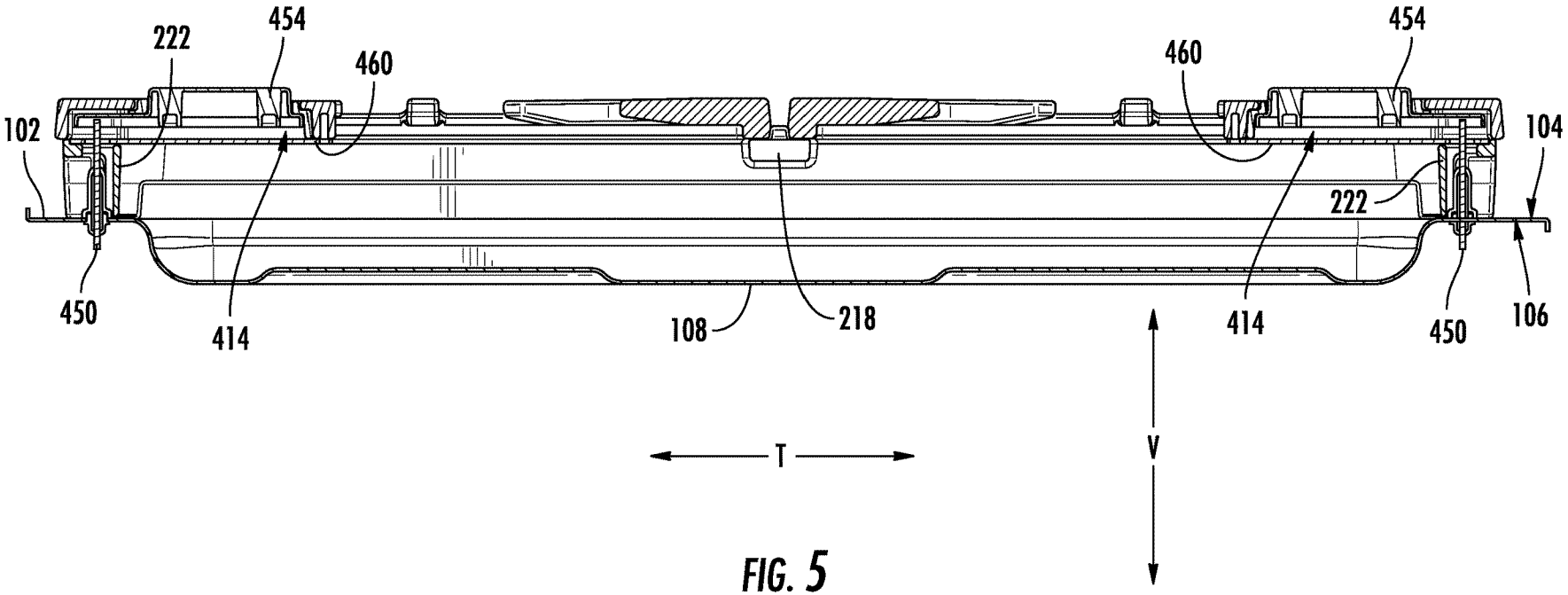
FIG. 5 provides a side section view of the example cooktop appliance of FIG. 1.

As best seen in FIG. 3, the flame ports 114 may be arranged in a circumferential array around the gas burner 110. The flame ports 114 may be spaced intermittently around the gas burner 110, e.g., with two or more groups of flame ports 114 and a corresponding number of gaps between the groups. For example, the flame ports 114 may be arranged in four generally equal groups, with four gaps 112 between the groups, e.g., the gaps 112 may be spaced about ninety degrees apart along or generally parallel to the perimeter, e.g., circumference, of the gas burner 110. Further, in some embodiments, e.g., as may be seen in FIG. 3, the sensor finger 410 may be aligned with one of the gaps 112, e.g., whereby the sensor finger 410 is not directly above one of the flame ports 114 along the vertical direction V.

As will be recognized by those of ordinary skill in the art, the gas burner 110, when activated, generates combustion products, e.g., flames and heated gases, which emanate from the flame ports 114. Thus, based on the configuration of the flame ports 114, e.g., the size, number, and spacing of the flame ports 114, the gas burner 110 may define a footprint, e.g., a maximum area on which the combustion products from the gas burner 110 may be impinged, and/or the maximum area through which such combustion products may flow. For example, when the quantity of fuel supplied to the gas burner 110 during operation is at maximum, the entire footprint of the gas burner 110 may be impinged upon by combustion products from the gas burner 100 and/or may have combustion products from the gas burner 110 flowing therethrough. As mentioned above, the temperature sensor 450 may be positioned outside of the footprint of the gas burner 110, and, as will be described below, the temperature probe 454 may extend from the temperature sensor 450 across a portion of the footprint of the gas burner 110 to contact a cooking utensil on the grate 400, thereby permitting the temperature sensor 450 to monitor a temperature at the cooking utensil through the temperature probe 454.

The thermally conductive temperature probe 454 may be mounted to or in the sensor finger 410, e.g., at least partly within the slot 414 as mentioned above. In some embodiments, the temperature probe 454 extends from the temperature sensor 450 to the sensor finger 410 above the gas burner 110. For example, the temperature sensor 450 may be spaced apart from the gas burner 110 and the sensor finger 410 above the gas burner 110, while the temperature probe 454 extends across the space between the temperature sensor 450 and the sensor finger 410, in particular to a cooking utensil position on the sensor finger 410, in order to permit the temperature sensor 450 to monitor a temperature of the cooking utensil (or at least a temperature that is directly related to the temperature of the cooking utensil by a known relationship, e.g. offset) while the temperature sensor 450 is also spaced apart from the cooking utensil and the gas burner 110. For example, temperature sensor 450 may contact thermally conductive probe 454 (see, e.g., FIGS. 6 and 7) at or proximate the second end 420 of sensor finger 410, e.g., away from the gas burner 110, whereby the temperature sensor 450 may be shielded from heating by the gas burner 110 at least in part by the distance between the temperature sensor 450 and the gas burner 110, e.g., according to the spacing as described. In particular, the temperature sensor 450 may include a tip 419 or uppermost end, and the tip 419 of the temperature sensor 450 may contact the thermally conductive probe 454, whereby the temperature sensor 450 may be positioned and configured to measure a temperature of the thermally conductive probe 454 and, when the probe 454 is in contact with a cooking utensil, the temperature measured by the temperature sensor 450 at the thermally conductive probe 454 may be related to the temperature of the cooking utensil, such as within a known range of the temperature of the cooking utensil based on the size, e.g., mass and/or length, of the probe 454 and thermal loss between the upper contact surface (e.g., at tip 419) of the probe 454 and the head 464 of the baseplate 462 of the thermally conductive probe 454. Thus, while the temperature sensor 450 may not necessarily measure or monitor the exact temperature of the cooking utensil, e.g., due to thermal losses through the temperature probe 454 as mentioned above, the temperature probe 450 described herein may monitor the temperature of the cooking utensil to ensure a temperature threshold, e.g. upper limit, is not exceeded. For example, an offset may be applied to the temperature measured by the temperature sensor 450 to arrive at or approximate the temperature of the cooking utensil in order to determine when the upper limit temperature for the cooking utensil and/or contents thereof is approached or reached, and, in some embodiments, the gas burner 110 may then be deactivated or its power reduced to avoid exceeding the upper limit temperature or to minimize the time during which the upper limit temperature is exceeded.

As mentioned above, the temperature sensor 450 may be spaced apart from the gas burner 110, e.g., along the radial direction and/or along the vertical direction V. In some embodiments, the temperature sensor or each temperature sensor may be positioned above the burner(s) 110 along the vertical direction V. In some embodiments, the temperature sensor 450 may be positioned outside of, e.g., above along the vertical direction V, the recessed portion 108 of the panel 102. Thus, the temperature sensor 450 may be protected from spillage, e.g., by positioning the temperature sensor 450 above the recessed portion 108 of the panel 102, and may be spaced apart from the gas burner(s) 110 by positioning the temperature sensor 450 above the recessed portion 108.

The temperature probe 454 may be in direct contact with the tip 419 of the temperature sensor 450. Thus, the temperature probe 454 may be in conductive thermal communication with the temperature sensor 450 via the tip 419 of the temperature sensor 450. For example, the tip 419 may be in direct contact with the temperature probe 454, and the temperature probe 454 may be in direct contact with a cooking utensil positioned on the grate 400 above the gas burner 110, such that the temperature sensor 450 is in conductive thermal communication with the temperature probe 454 and with the cooking utensil via the temperature probe 454.

Figure 6:
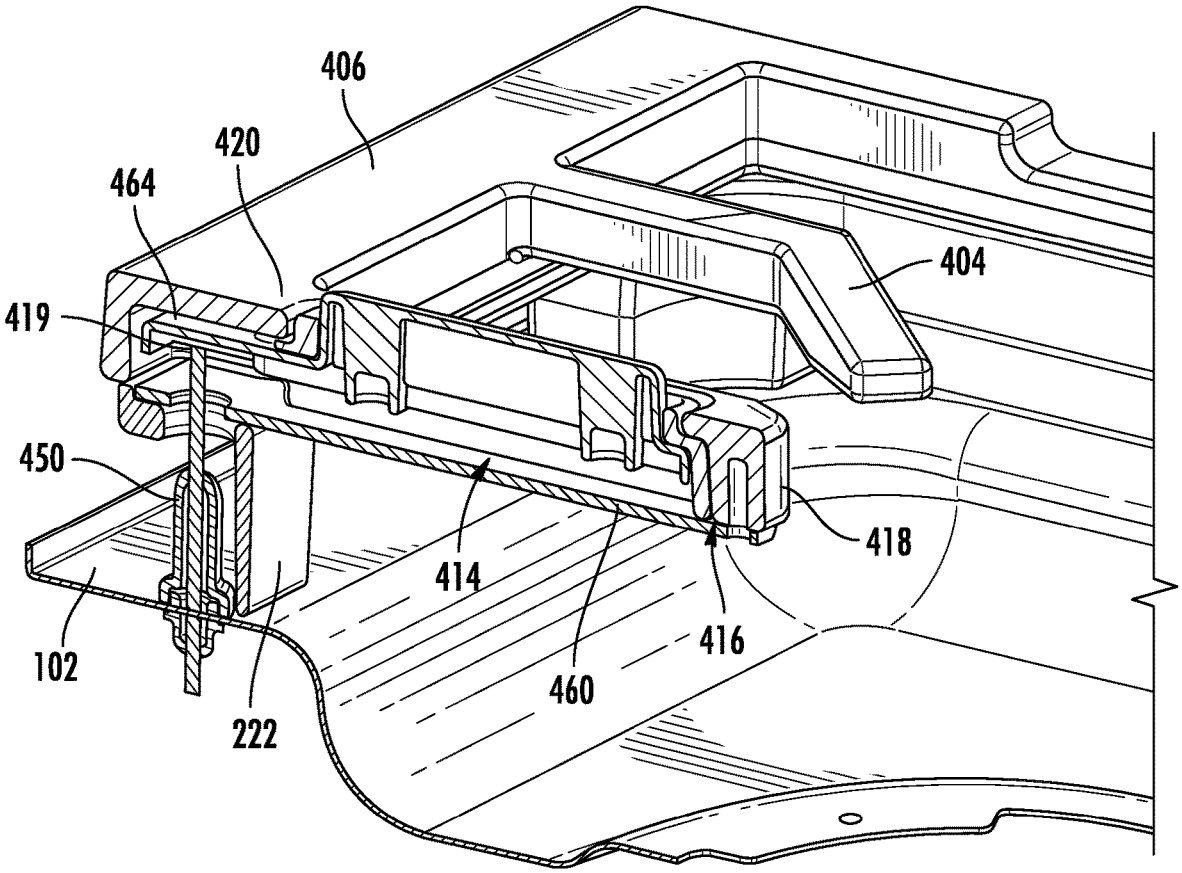
FIG. 6 provides a sectioned perspective view of a portion of the example cooktop appliance of FIG. 1.
Figure 7:
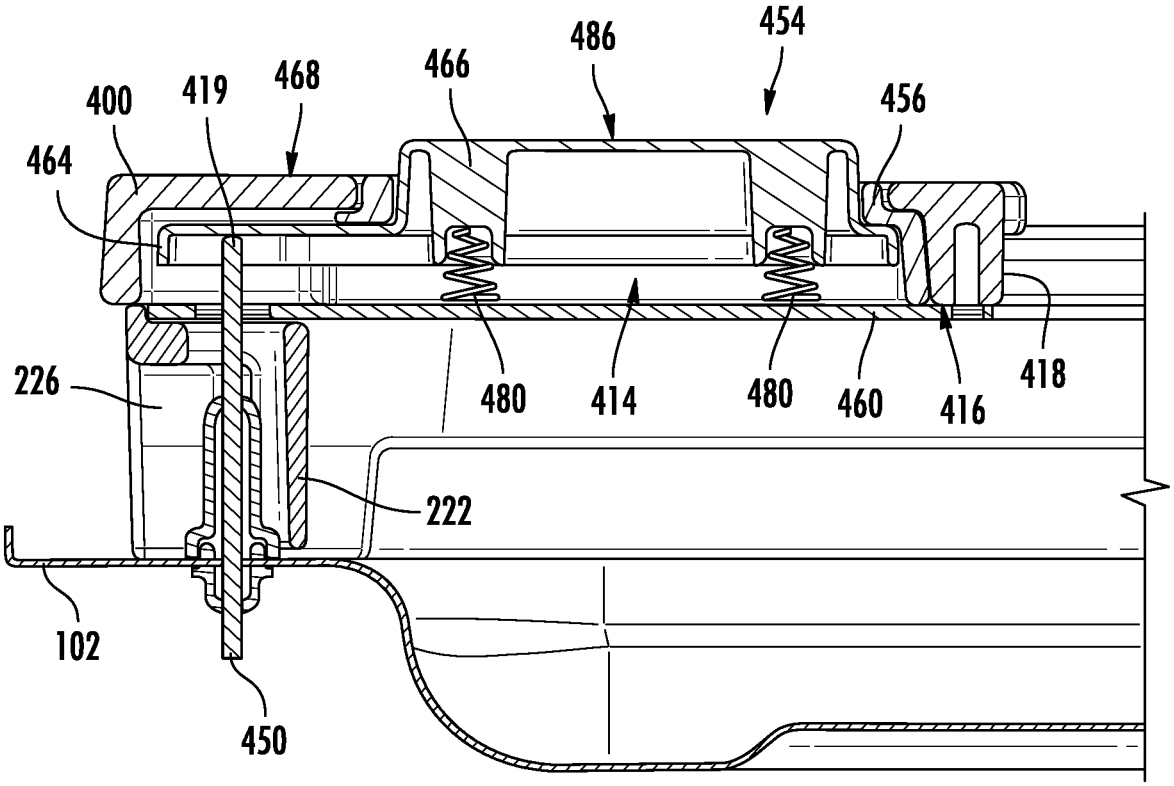
FIG. 7 provides a side section view of a portion of the example cooktop appliance of FIG. 1.

In some embodiments, e.g., as illustrated in FIGS. 6, 7, and 8, the cooktop appliance 100 may also include a sleeve 222, e.g., the frame 200 may include a sleeve 222 which encloses the temperature sensor 450 on at least three sides when the frame 200 is mounted to the top surface 104 of the panel 102. In additional embodiments, the sleeve 222 may also be provided as part of the temperature sensor 450 or top panel 102 instead of as a part of the frame 200.

The temperature probe 454 may be coupled to or in operative communication with a biasing member or spring 480 (see, e.g., FIG. 7) such that the temperature probe 454 is urged upwardly. As mentioned, each finger of the plurality of fingers 404, including the sensor finger 410, may include a top surface 468. Thus, the temperature probe 454 may be urged towards the top surface 468 of the sensor finger 410, e.g., towards a utensil positioned thereon, by the spring 480. In particular, the temperature probe 454 may be urged upward along the vertical direction V by the spring 480, e.g., towards the top surface 468 of the sensor finger 410 from within the sensor finger 410 and at least partially above the top surface 468, e.g., at least a contact surface 486 of the temperature probe 454 on the button 466 of the temperature probe 454 may be positioned above the top surface 468. In some embodiments, e.g., as illustrated in FIG. 7, the biasing element may be a helical spring or conical spring 480, and more than one biasing element may be provided, such as two biasing elements as illustrated in FIG. 7. In additional embodiments, the biasing element may also or instead include one or more other suitable springs, such as a leaf spring, a cylindrical spring, or other suitable biasing element as will be understood by those of ordinary skill in the art.

Thus, the temperature probe 454 may be positioned in sensor finger 410 such that the temperature probe 454 is configured to contact a cooking utensil and is configured to be in conductive thermal communication with the cooking utensil, such that a temperature of the temperature probe 454 measured by the temperature sensor 450 is related to the temperature of the cooking utensil on the grate 400 when the cooking utensil is heated by the corresponding gas burner 110. For example, the temperature measured by the temperature sensor 450 may be used as a safety feature, such as to define an upper limit, e.g., a cut-off temperature, at or above which the gas burner 110 may be shut down, such as to avoid overheating the cooking utensil and/or items therein, in particular oils which may have a high evaporation point. In such embodiments, the cut-off temperature may include or be based on an offset or safety factor, such as the cut-off temperature may be less than a temperature of concern by the offset, and the offset may be based on the thermal properties of the temperature probe 454, such as based on a temperature loss from the cooking utensil to the temperature sensor 450 through the temperature probe 454.

The temperature probe 454 may include a baseplate 462, and a contact pad or head 464 may be formed on an end of the baseplate 462. For example, as may be seen in FIGS. 6, 7, and 8, the temperature sensor 450, e.g., the tip 419 thereof, may contact the baseplate 462 of the temperature probe 454 at the contact pad or head 464, such as on a bottom surface of the baseplate 462. The temperature probe 454 may further include a projection or button 466 which extends, e.g., generally upwardly along the vertical direction V when installed in the sensor finger 410, from the baseplate 462.

Additionally, in some embodiments, the contact between the tip 419 of the temperature sensor 450 and the temperature probe 454 may vary when the temperature probe 454 is weighed down by a cooking utensil, e.g., a degree of contact pressure where the tip 419 touches the temperature probe 454 may vary. In such embodiments, the temperature probe 454, in particular when the temperature probe 454 is spring-loaded, e.g., is biased upwards by one or more biasing elements as described above, may also provide deflection information, such that cookware presence may be assessed, e.g., in response to a variation in contact pressure from the temperature probe 454. Thus, the temperature sensor 450 may be able to determine when a cooking utensil is present and, e.g., may relay a corresponding signal to the controller 130 of the cooktop appliance 100.

The temperature probe 454 may advantageously provide an enlarged contact surface 486 for contacting the underside of a cooking utensil and thereby promoting heat transfer from the cooking utensil to the temperature probe 454. For example, the contact surface 486 may be an elongated contact surface, e.g., elongated generally along the radial direction, in order to contact cooking utensils of various sizes, e.g., various diameters. For example, the radially elongated shape of the button 466 and the contact surface 486 thereon may ensure that at least a portion of the cooking utensil is in direct contact with the temperature probe 454, e.g., regardless of the size, e.g., diameter, of the cooking utensil, within a certain range of common or expected cooking utensil diameters, e.g., proportional to the size, e.g., diameter, of the gas burner 110.

In some embodiments, the temperature probe 454 may be spaced apart from the grate 400, including the sensor finger 410 thereof, to prevent conductive heat transfer between the grate 400 and the temperature probe 454. For example, the temperature probe 454, in some embodiments, does not touch the grate 400. In some embodiments, the temperature probe 454 may be spaced apart from the grate 400 continuously around a circumference of the temperature probe 454, e.g., such that the entire perimeter, e.g., circumference, of the temperature probe 454 is not in contact with the sensor finger 410 (or any other part of the grate 400), including the button 466 of the temperature probe 454 which extends through the sensor finger 410 is not in contact with the sensor finger 410.

In some embodiments, the temperature probe 454 may define an outer dimension, such as a width and/or length, which is less than a corresponding dimension, e.g., an inner width and/or length of the sensor finger 410. For example, the sensor finger 410 may include an aperture 428, and the temperature probe 454, e.g., the button 466 thereof, may pass upwards along the vertical direction V through the aperture 428 without contacting any edges of the aperture 428.

In some embodiments, the temperature probe 454 may be further thermally isolated from the grate 400 and the sensor finger 410 by a thermally insulative housing 456. Where the temperature probe 454 comprises a thermally conductive material, the housing 456 may comprise a thermally insulative material, where the terms "thermally conductive" and "thermally insulative" may be understood each with respect to and relative to the other. For example, the thermally conductive temperature probe 454 may be at least about five times as thermally conductive as the thermally insulative housing 456, e.g., a ratio of the thermal conductivity of the probe 454 to the thermal conductivity of the housing 456 may be at least about 5:1, such as about 10:1 or more, such as about 50:1 or more, such as about 100:1 or more, such as about 150:1 or more, such as about 200:1 or more, such as about 275:1 or about 300:1. In various embodiments, the temperature probe 454 may comprise any suitable heat conductive material, such as a highly heat conductive metallic material, e.g., aluminum, copper, and/or alloys thereof such as A360 aluminum alloy, and the housing 456 may comprise a less heat conductive material such as a ceramic material, or a low heat conductivity metal material such as alumina (aluminum oxide) or stainless steel. Thus, the temperature probe 454 may, by way of example, have a k-value (in Watts per meter-Kelvin or W/mK) of about 150 (e.g., for A360 alloy, which may permit the temperature probe 454 to be cast), or about 230 (e.g., for aluminum, where the temperature probe 454 may be formed by casting), or about 410 (e.g., for copper), whereas such probe 454 may be paired with a housing having a k-value of between about one and about two (e.g., for a ceramic material), or a k-value of about fifteen (e.g., for a stainless steel alloy), or about thirty (e.g., for alumina).

As may be seen, e.g., in FIG. 8, the temperature sensor 450 may extend upward generally along the vertical direction V from the top panel 102, e.g., to the tip 419 of the temperature sensor 450, where a portion of the temperature sensor 450, e.g., at least the tip 419 thereof, extends into the grate 400 in order to contact the thermally conductive probe 454 within the grate 400, e.g., within the sensor finger 410 of the grate 400. In some embodiments, the cover plate 460 may extend along the radial direction across the entire slot 414 in the sensor finger 410. In such embodiments, the cover plate 460 may include an aperture (as illustrated, e.g., in FIG. 8) through which the temperature sensor 450 extends, whereby the tip 419 is located above the cover plate 460 when assembled (see, e.g., FIGS. 6 and 7) to contact the temperature probe 454.

The construction of the sensor finger 410 and temperature sensor 450 as described herein provides numerous advantages. For example, temperature sensor 450 is advantageously positioned in thermal communication, e.g., indirect conductive thermal communication through the temperature probe 454, with a cooking utensil on the grate 400 yet temperature sensor 450 is also shielded by sleeve 222 and the temperature probe 454 is shielded by cover plate 460 from direct convective heating by gas burner 110. The foregoing advantages are described by way of example only and without limitation. Additional advantages of the present disclosure may also be apparent to those of ordinary skill in the art.

The cooktop appliance 100 shown in the accompanying figures and described herein illustrates various example embodiments of the present disclosure. Thus, although described in the context of cooktop appliance 100, the present disclosure may be used in cooktop appliances having other configurations, e.g., a cooktop appliance with fewer burner assemblies or additional burner assemblies. Similarly, the present disclosure may be used in cooktop appliances that include an oven, i.e., range appliances. As another example, the present disclosure may be used with a cooktop appliance without a separate frame or frames, e.g., where the grate(s) may be positioned directly on the top panel, such as grates 400 and/or 402 may include vertical portions, such as legs, and may be positioned directly on panel 102. Additional other and further variations in the configuration of the cooktop appliance 100 as will be understood by those of ordinary skill in the art are also contemplated as being within the scope of the present disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A cooktop appliance defining a vertical direction, a lateral direction, and a transverse direction, the vertical direction, the lateral direction, and the transverse direction being mutually perpendicular, the cooktop appliance comprising:

a top panel;

a gas burner disposed on the top panel;

a grate with a plurality of fingers removably positioned above the gas burner, the plurality of fingers including a sensor finger;

a temperature sensor extending upward generally along the vertical direction from the top panel adjacent to the gas burner, wherein the temperature sensor is positioned outside of a footprint of the gas burner; and a thermally conductive probe extending from the temperature sensor to the sensor finger above the gas burner, the thermally conductive probe comprising a button extending above the sensor finger along the vertical direction, the button configured to contact a utensil positioned on the grate, wherein the sensor finger extends from a perimeter of the grate towards the gas burner along a radial direction generally perpendicular to the vertical direction, and wherein the button extends across at least two-thirds of a length of the sensor finger along the radial direction.

2. The cooktop appliance of claim 1, wherein the thermally conductive probe comprises a baseplate in contact with the temperature sensor.

3. The cooktop appliance of claim 1, further comprising a biasing member positioned below the button, the biasing member configured to urge the button upward along the vertical direction.

4. The cooktop appliance of claim 1, further comprising a thermally insulative housing disposed within the sensor finger, the thermally insulative housing positioned between the thermally conductive probe and the sensor finger, whereby the thermally conductive probe is thermally isolated from the sensor finger.

5. The cooktop appliance of claim 1, further comprising a sleeve extending around the temperature sensor, the sleeve positioned between the temperature sensor and the gas burner, whereby the temperature sensor is shielded from direct heating from the gas burner by the sleeve.

6. The cooktop appliance of claim 1, wherein the gas burner comprises a plurality of flame ports arranged in a circumferential array about the gas burner, and wherein the sensor finger is positioned above a gap between adjacent flame ports of the plurality of flame ports.

7. The cooktop appliance of claim 1, further comprising a cover plate fastened to a bottom of the sensor finger, whereby the cover plate is positioned between the thermally conductive probe and the gas burner along the vertical direction, whereby the thermally conductive probe is shielded from direct heating from the gas burner by the cover plate.

8. The cooktop appliance of claim 1, wherein the temperature sensor extends into the grate in order to contact the thermally conductive probe when the grate is mounted on the top panel.

9. A cooktop appliance, comprising:

a top panel;

a gas burner disposed on the top panel;

a grate with a plurality of fingers removably positioned above the gas burner, the plurality of fingers including a sensor finger;

a temperature sensor extending from the top panel adjacent to the gas burner, wherein the temperature sensor is positioned outside of a footprint of the gas burner;

a thermally conductive probe extending from the temperature sensor to the sensor finger above the gas burner; and a sleeve extending around the temperature sensor, the sleeve positioned between the temperature sensor and the gas burner, whereby the temperature sensor is shielded from direct heating from the gas burner by the sleeve.

10. The cooktop appliance of claim 9, wherein the thermally conductive probe comprises a baseplate in contact with the temperature sensor.

11. The cooktop appliance of claim 9, wherein the thermally conductive probe comprises a button extending above the sensor finger, the button configured to contact a utensil positioned on the grate.

12. The cooktop appliance of claim 11, wherein the sensor finger extends from a perimeter of the grate towards the gas burner along a radial direction, and wherein the button extends across at least two-thirds of a length of the sensor finger along the radial direction.

13. The cooktop appliance of claim 11, further comprising a biasing member positioned below the button, the biasing member configured to urge the button upward.

14. The cooktop appliance of claim 9, further comprising a thermally insulative housing disposed within the sensor finger, the thermally insulative housing positioned between the thermally conductive probe and the sensor finger, whereby the thermally conductive probe is thermally isolated from the sensor finger.

15. The cooktop appliance of claim 9, wherein the gas burner comprises a plurality of flame ports arranged in a circumferential array about the gas burner, and wherein the sensor finger is positioned above a gap between adjacent flame ports of the plurality of flame ports.

16. The cooktop appliance of claim 9, further comprising a cover plate fastened to a bottom of the sensor finger, whereby the cover plate is positioned between the thermally conductive probe and the gas burner, whereby the thermally conductive probe is shielded from direct heating from the gas burner by the cover plate.

17. The cooktop appliance of claim 9, wherein the temperature sensor extends into the grate in order to contact the thermally conductive probe when the grate is mounted on the top panel.

18. A cooktop appliance, comprising:

a top panel;

a gas burner disposed on the top panel;

a grate with a plurality of fingers removably positioned above the gas burner, the plurality of fingers including a sensor finger;

a temperature sensor extending from the top panel adjacent to the gas burner, wherein the temperature sensor is positioned outside of a footprint of the gas burner;

a thermally conductive probe extending from the temperature sensor to the sensor finger above the gas burner; and a cover plate fastened to a bottom of the sensor finger, whereby the cover plate is positioned between the thermally conductive probe and the gas burner, whereby the thermally conductive probe is shielded from direct heating from the gas burner by the cover plate.

19. The cooktop appliance of claim 18, wherein the gas burner comprises a plurality of flame ports arranged in a circumferential array about the gas burner, and wherein the sensor finger is positioned above a gap between adjacent flame ports of the plurality of flame ports.

20. The cooktop appliance of claim 18, wherein the thermally conductive probe comprises a button extending above the sensor finger, the button configured to contact a utensil positioned on the grate, wherein the sensor finger extends from a perimeter of the grate towards the gas burner along a radial direction, and wherein the button extends across at least two-thirds of a length of the sensor finger along the radial direction.

* * * * *